US011464311B1

(12) United States Patent
Sawyers et al.

(10) Patent No.: US 11,464,311 B1
(45) Date of Patent: Oct. 11, 2022

(54) SYSTEMS, DEVICES, AND METHODS FOR PREVENTING BURNS

(71) Applicants: Donna Sawyers, Shawsville, VA (US); Jeff Levy, Radford, VA (US)

(72) Inventors: Donna Sawyers, Shawsville, VA (US); Jeff Levy, Radford, VA (US)

( * ) Notice: Subject to any disclaimer, the term of this patent is extended or adjusted under 35 U.S.C. 154(b) by 146 days.

(21) Appl. No.: 17/146,629

(22) Filed: Jan. 12, 2021

Related U.S. Application Data

(60) Provisional application No. 63/100,420, filed on Mar. 12, 2020.

(51) Int. Cl.
*A45D 6/18* (2006.01)
*A45D 1/06* (2006.01)

(52) U.S. Cl.
CPC ..... *A45D 6/18* (2013.01); *A45D 1/06* (2013.01)

(58) Field of Classification Search
CPC ... A45D 6/00; A45D 6/02; A45D 6/04; A45D 6/18; A45D 1/00; A45D 1/02; A45D 1/04; A45D 1/06; A45D 1/08; A45D 1/10; A45D 1/14; A45D 1/18; A45D 1/16; A45D 1/28; A45D 2/00; A45D 2/001; A45D 2/04; A45D 2/06; A45D 2/16; A45D 2/26; A45D 2/28; A45D 2/30; A45D 2/32; A45D 2/367; A45D 2/2457
See application file for complete search history.

(56) References Cited

U.S. PATENT DOCUMENTS

| | | | | |
|---|---|---|---|---|
| 2004/0251245 | A1* | 12/2004 | Oh | A45D 1/10 219/225 |
| 2010/0108831 | A1* | 5/2010 | Leung | A45D 1/00 248/176.2 |
| 2011/0203606 | A1* | 8/2011 | Recchion | A45D 1/04 132/269 |
| 2013/0146081 | A1* | 6/2013 | Chan | A45D 1/04 132/229 |
| 2019/0059545 | A1* | 2/2019 | Hongwei | A45D 6/04 |
| 2020/0138160 | A1* | 5/2020 | Habibi | A45D 1/08 |
| 2020/0138168 | A1* | 5/2020 | Godin | A46B 9/005 |

* cited by examiner

*Primary Examiner* — Rachel R Steitz
*Assistant Examiner* — Karim Asqiriba

(57) ABSTRACT

Certain exemplary embodiments can provide a system, machine, device, and/or manufacture configured or adapted for, and/or a method for, activities that can comprise and/or relate to a burn guard system configured or adapted to operably prevent burns to the skin of a user of a heated hair curling iron.

15 Claims, 9 Drawing Sheets

SYSTEMS, DEVICES, AND METHODS FOR PREVENTING BURNS

CROSS-REFERENCES TO RELATED APPLICATIONS

This application claims priority to, and incorporates by reference herein in its entirety, pending U.S. Provisional Patent Application 63/100,420, filed 12 Mar. 2020.

BRIEF DESCRIPTION OF THE DRAWINGS

A wide variety of potential, feasible, and/or useful embodiments will be more readily understood through the herein-provided, non-limiting, non-exhaustive description of certain exemplary embodiments, with reference to the accompanying exemplary drawings in which.

Drawing Key

| Element Name | Element Number |
|---|---|
| Hair curling iron burn guard system | 1000 |
| Hair curling iron | 1100 |
| Wand | 1120 |
| Wand Insulator | 1130 |
| Barrel | 1140 |
| Barrel tip | 1142 |
| Barrel outer surface | 1144 |
| Barrel covered zone | 1146 |
| Barrel clear zone | 1148 |
| Clamp | 1160 |
| Clamp outer surface | 1162 |
| Clamp inner surface | 1164 |
| Clamp tip | 1166 |
| Clamp edge | 1168 |
| Clamp trigger | 1180 |
| Clamp hinge | 1182 |
| Barrel guard | 1200 |
| Barrel guard annular retainer | 1220 |
| Barrel guard penannular clip | 1240 |
| Barrel guard plate | 1250 |
| Barrel guard spines | 1260 |
| Barrel guard ribs | 1280 |
| Barrel guard rib tips | 1282 |
| Barrel guard gaps | 1284 |
| Barrel trigger bridge | 1290 |
| Clamp guard | 1300 |
| Clamp guard retaining lip | 1320 |
| Clamp guard ribs | 1340 |
| Clamp guard rib tips | 1342 |
| Clamp guard gaps | 1344 |
| Clamp guard plate | 1350 |
| Clamp guard spines | 1360 |

DESCRIPTION

Certain exemplary embodiments can provide a system, machine, device, and/or manufacture configured or adapted for, and/or a method for, activities that can comprise and/or relate to a burn guard system configured or adapted to operably prevent burns to the skin of a user of a heated hair curling iron.

Figure 1:
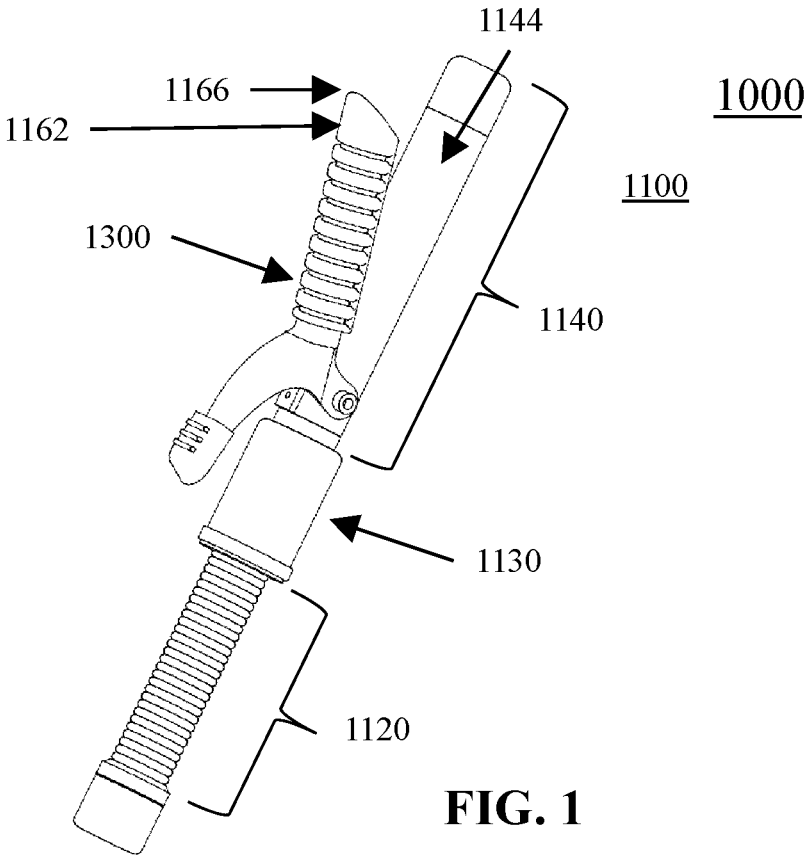
FIG. 1 is a perspective view of an exemplary embodiment of a system 1000.
Figure 2:
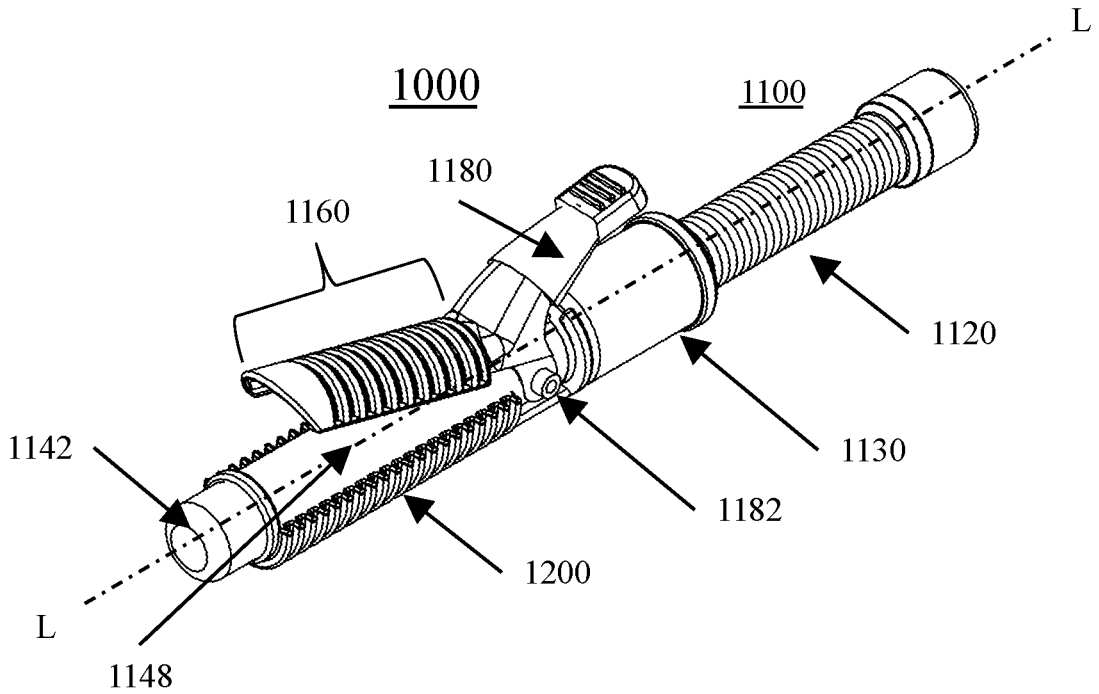
FIG. 2 is a perspective view of an exemplary embodiment of a system 1000.
Figure 3:
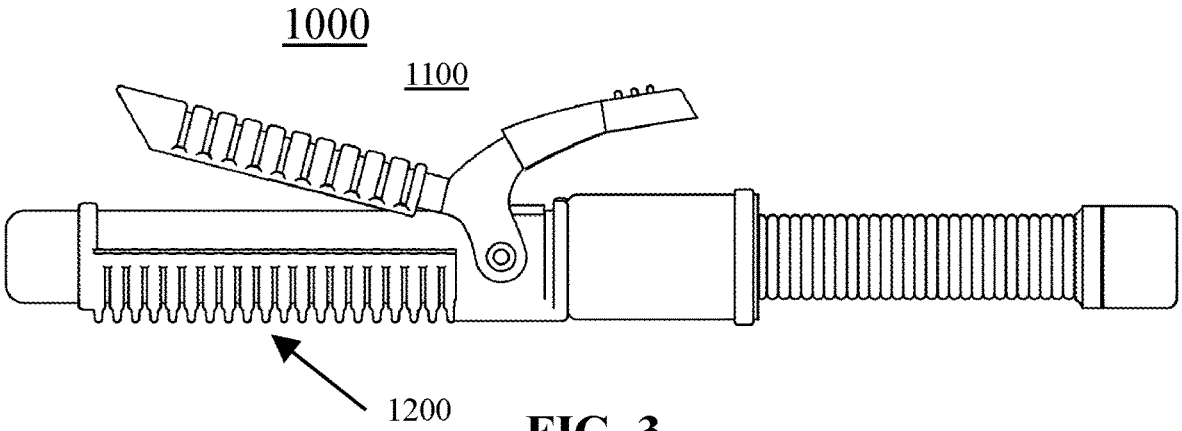
FIG. 3 is a side view of an exemplary embodiment of a system 1000.
Figure 4:
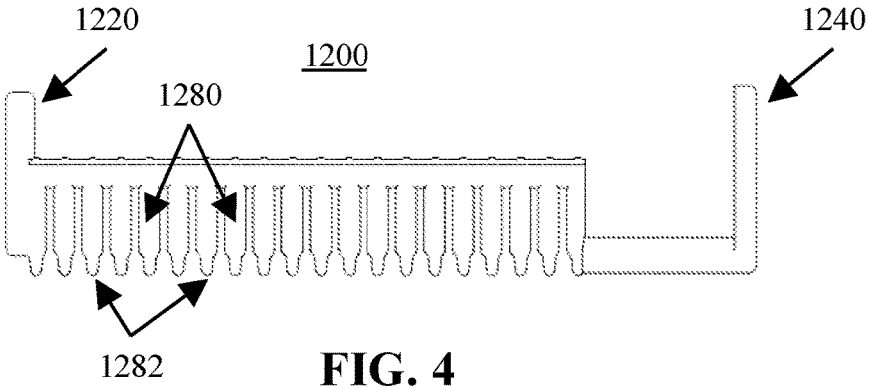
FIG. 4 is a side view of an exemplary embodiment of a barrel guard 1200.
Figure 5:
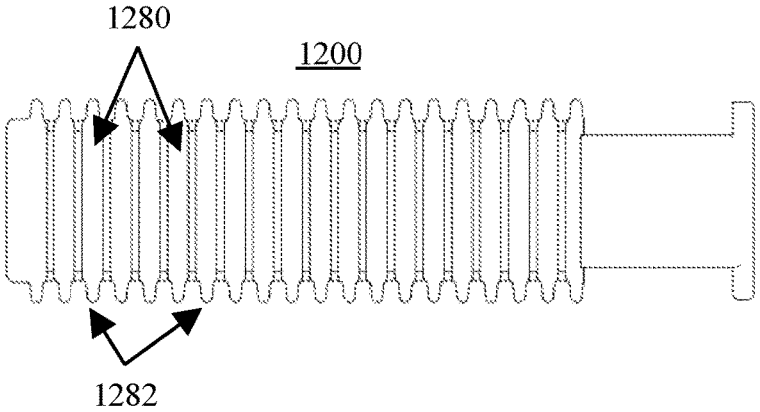
FIG. 5 is a top view of an exemplary embodiment of a barrel guard 1200.
Figure 6:
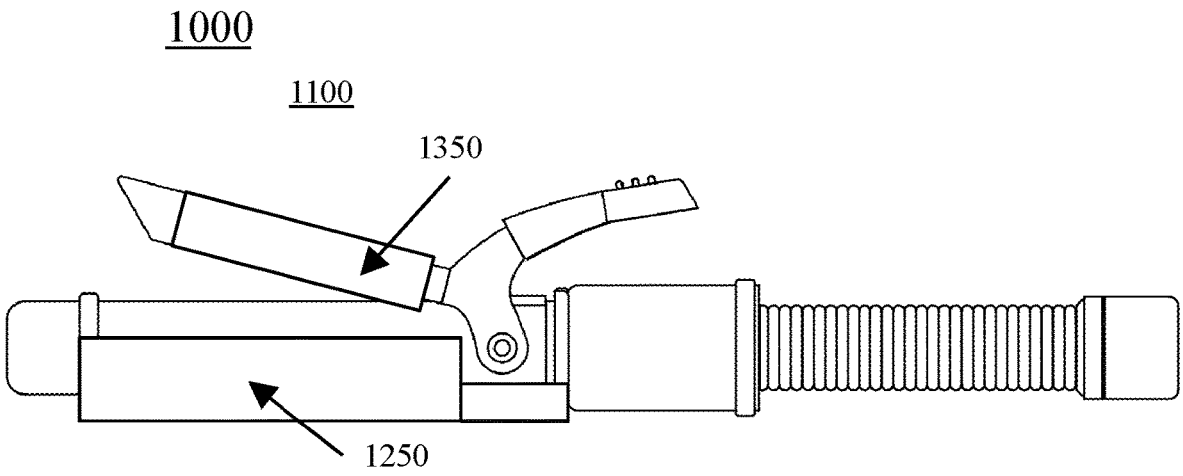
FIG. 6 is a side view of an exemplary embodiment of a system 1000.
Figure 7:
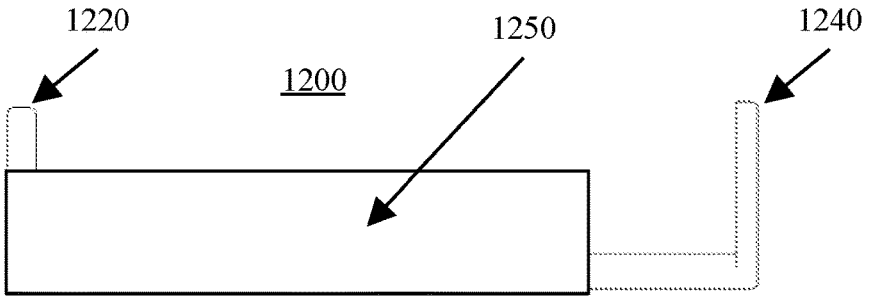
FIG. 7 is a side view of an exemplary embodiment of a barrel guard 1200.
Figure 8:
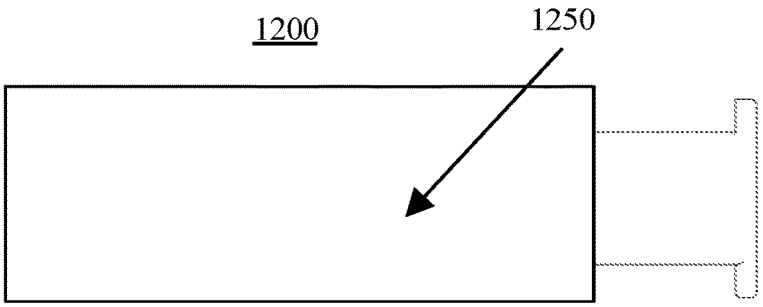
FIG. 8 is a top view of an exemplary embodiment of a barrel guard 1200.
Figure 9:
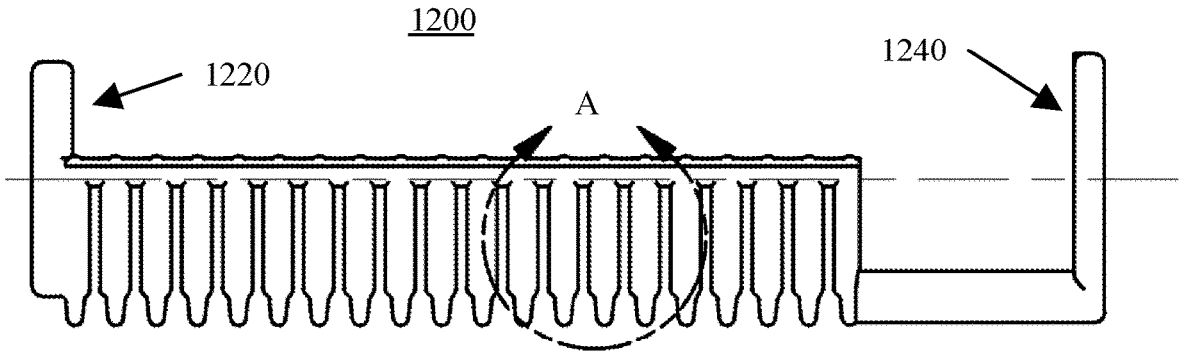
FIG. 9 is a side view, taken at detail A, of an exemplary embodiment of a barrel guard 1200.
Figure 10:
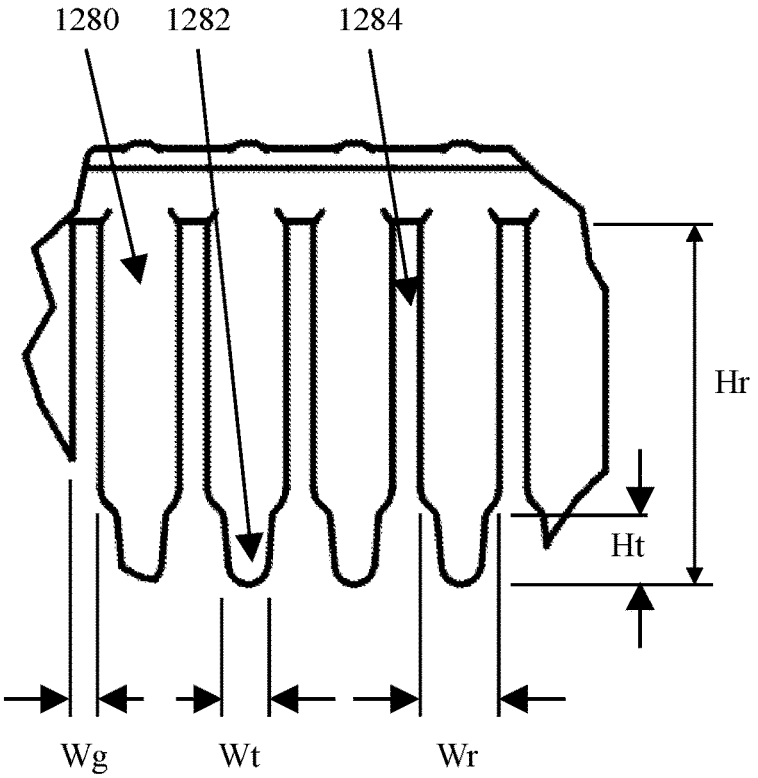
FIG. 10 is a side view of an exemplary embodiment of a barrel guard 1200.
Figure 11:
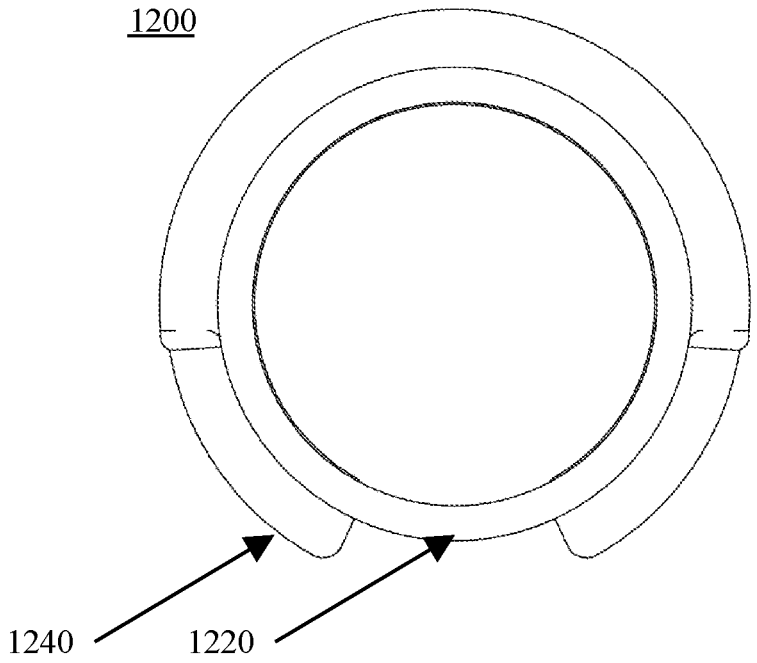
FIG. 11 is an end view of an exemplary embodiment of a barrel guard 1200.
Figure 12:
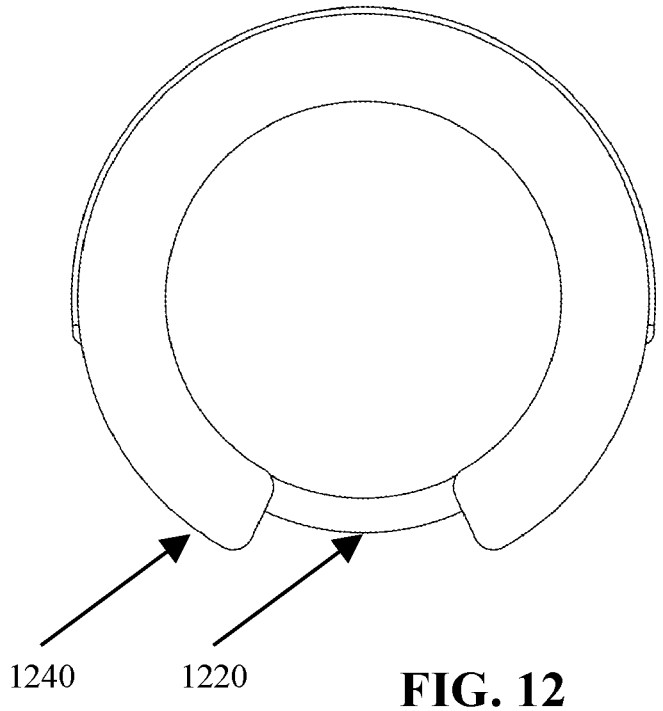
FIG. 12 is an opposite end view of an exemplary embodiment of a barrel guard 1200.
Figure 13:
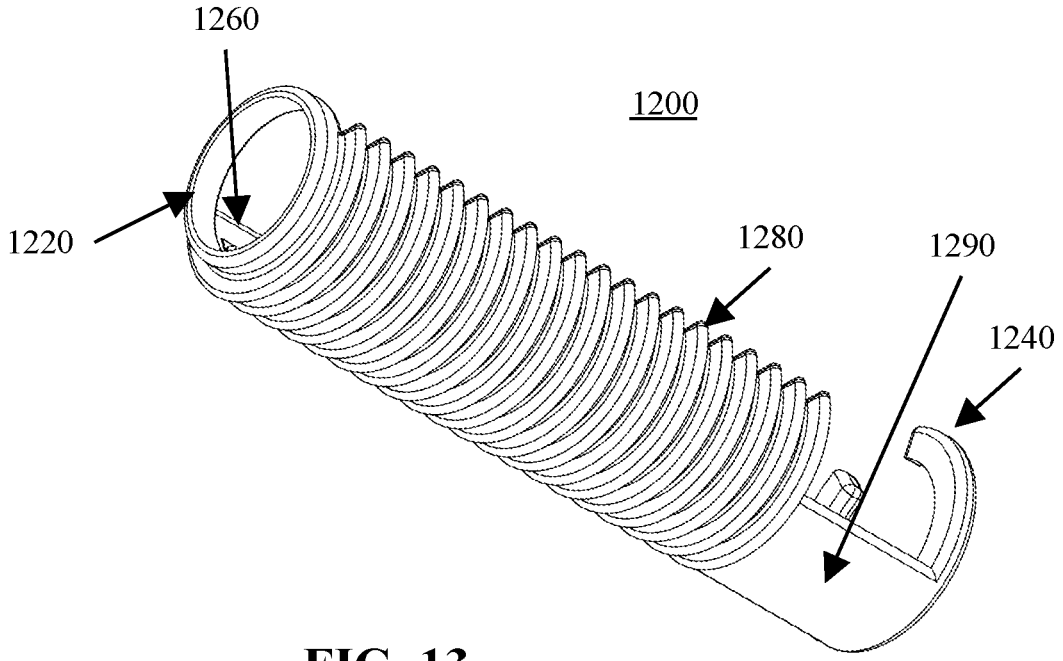
FIG. 13 is a bottom perspective view of an exemplary embodiment of a barrel guard 1200.
Figure 14:
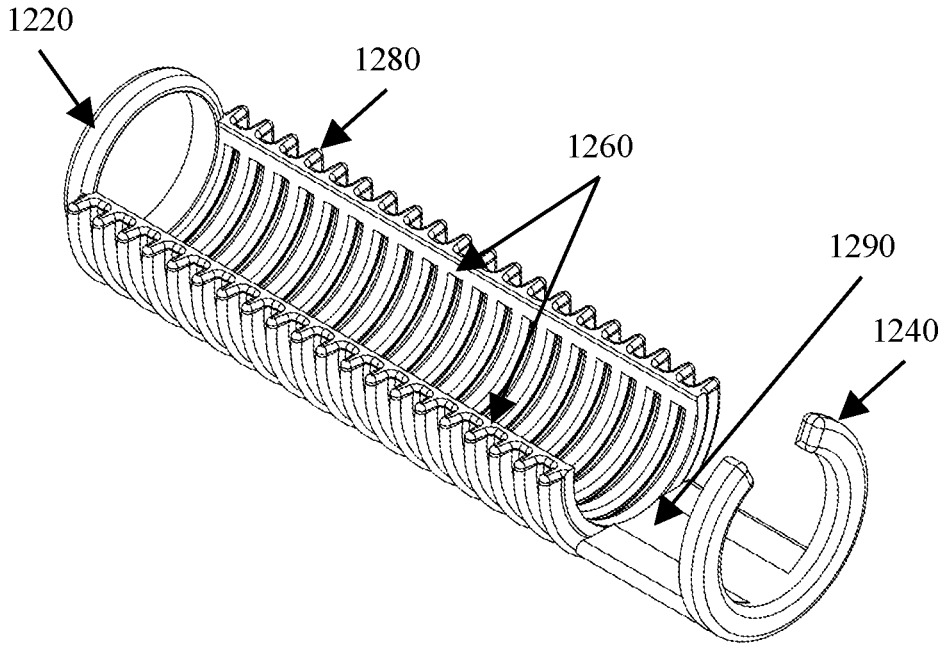
FIG. 14 is a top perspective view of an exemplary embodiment of a barrel guard 1200.
Figure 15:
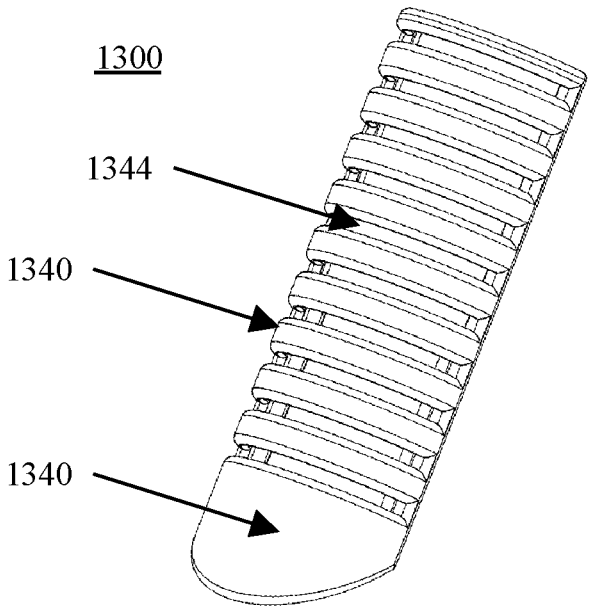
FIG. 15 is a bottom perspective view of an exemplary embodiment of a clamp guard 1300.
Figure 16:
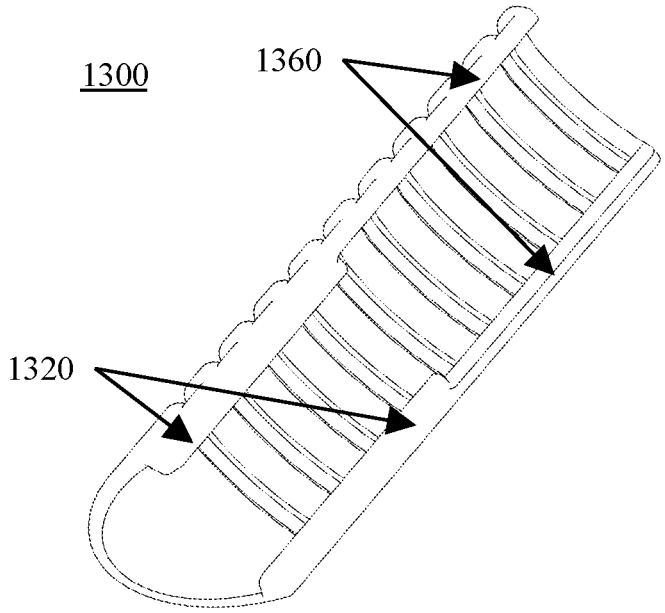
FIG. 16 is a top perspective view of an exemplary embodiment of a clamp guard 1300.
Figure 17:
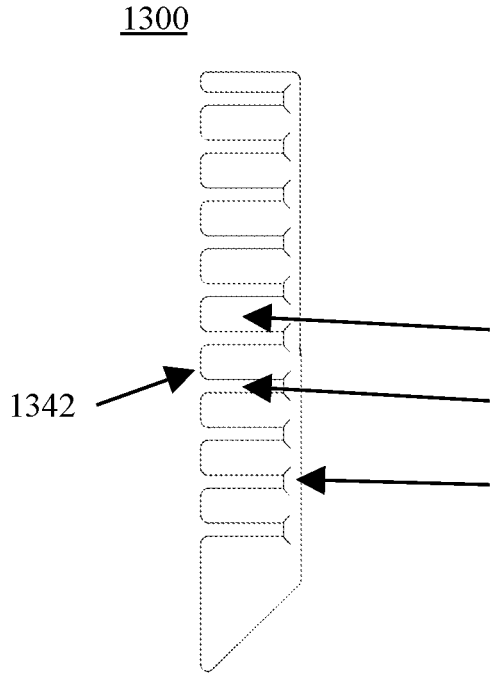
FIG. 17 is a side view of an exemplary embodiment of a clamp guard 1300.
Figure 18:
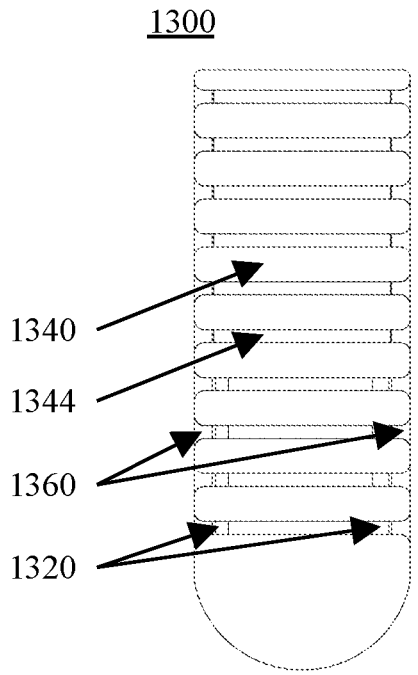
FIG. 18 is a top view of an exemplary embodiment of a clamp guard 1300.
Figure 19:
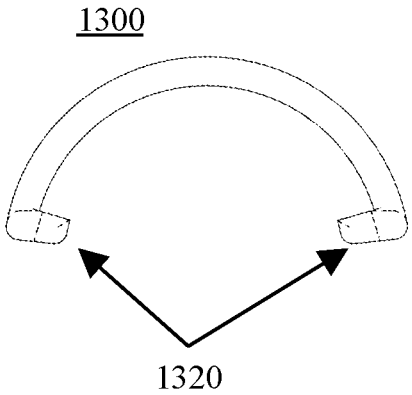
FIG. 19 is an end view of an exemplary embodiment of a clamp guard 1300.
Figure 20:
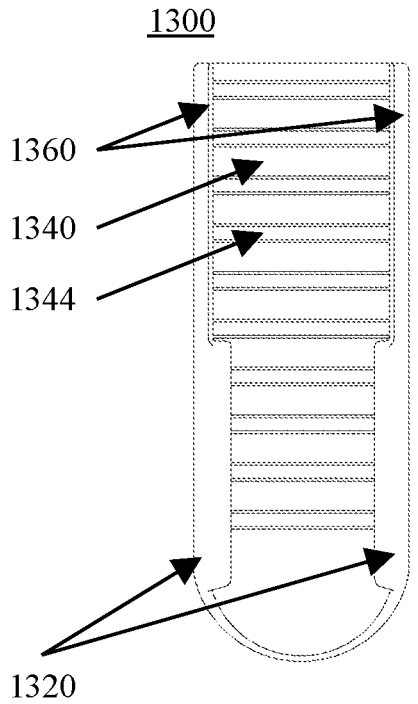
FIG. 20 is a bottom view of an exemplary embodiment of a clamp guard 1300.
Figure 21:
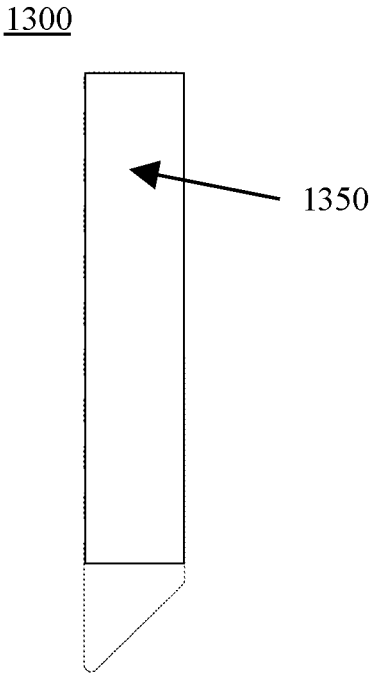
FIG. 21 is a side view of an exemplary embodiment of a clamp guard 1300.
Figure 22:
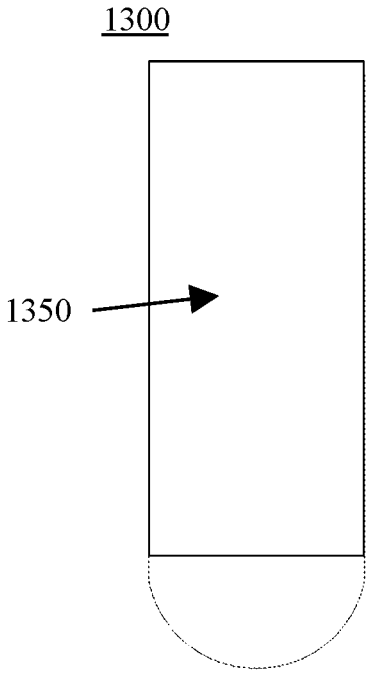
FIG. 22 is a top view of an exemplary embodiment of a clamp guard 1300.
Figure 23:
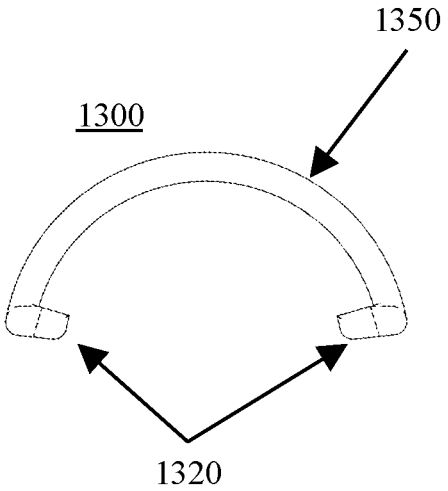
FIG. 23 is an end view of an exemplary embodiment of a clamp guard 1300.
Figure 24:
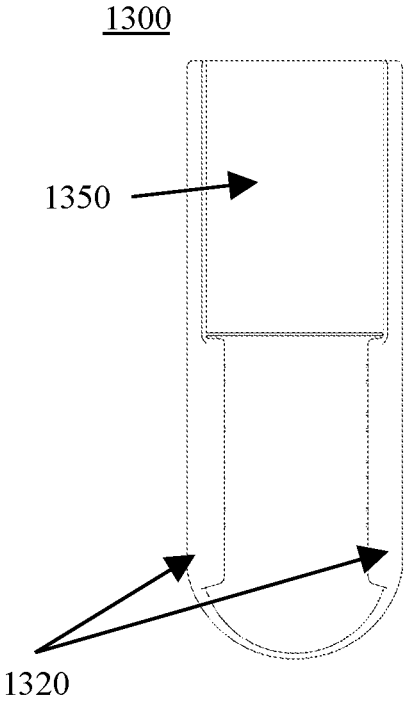
FIG. 24 is a bottom view of an exemplary embodiment of a clamp guard 1300.

Referring to FIGS. 1-24, certain exemplary embodiments can provide a burn guard system 1000 configured to operably prevent burns to the skin of a user of a heated hair curling iron 1100. An exemplary curling iron 1100 (such as an Instant Heat model curling iron from Conair of Stamford, CT) can define a wand 1120 configured to be held in a hand of the users. Wand 1120 can be separated by a wand insulator 1130 from an elongate, substantially cylindrical, heated barrel 1140 that terminates in an insulated barrel tip 1142 and defines a barrel outer surface 1144, which can be formed from metal.

A clamp 1160 can be pivotably connected to barrel 1140 via a clamp hinge 1182 that includes a spring or other means of biasing a clamp inner surface 1164 toward and/or into contact with a barrel outer surface 1144. Clamp 1160 can define a tip 1166 at its terminus and an edge 1168. Connected to claim 1160 (integrally or otherwise) can be a clamp trigger 1180 to which a thumb of the user can apply force to rotatably move clamp inner surface 1164 away from barrel outer surface 1144.

Barrel 1140 can be configured to substantially surround a heating system that generates heat electrically and/or via combustion, such as of a gas (e.g., butane, propane, etc.), the heating system stored within curling iron 1100. The heating system can be configured to substantially maintain the metallic outer barrel surface 1144 at a predetermined temperature. A user-actuated single- or multi-position switch located on, e.g., wand insulator 1130, can initiate or terminate heating of barrel 1140 and/or outer barrel surface 1144. A control circuit can control the application of heat in manner that prevents outer barrel surface 1144 from exceeding a predetermined temperature that falls within a range of, e.g., 200 degrees F. to 450 degrees F., including all values and subranges therebetween. The switch can allow a user to select any of several desired maximum and/or average temperatures for outer barrel surface 1144. A visual ready signal can indicate when the user-selected temperature has been reached. A timing sub-circuit can turn off heating of barrel 1140 after a predetermined time, such as a predetermined time without substantial movement of curling iron 1100. Because an inner surface 1164 of clamp 1160 can be biased into substantial contact with an outer surface 1144 of barrel 1140, a temperature of inner surface 1164 or outer surface 1162 of clamp 1160 can reach and/or approach that of outer surface 1144.

The temperature needed to change the straightness of human scalp hair (generally at least 150 degrees F.) is higher than the temperature at which human skin cells begin to experience irreparable thermal burn damage. For example, exposure of moist human skin to:

- 120° F. (49° C.) can lead to a second degree burn (blisters) in 8 minutes and/or a third degree burn (white or black char, all layers damaged, and loss of pain sensitivity) in 10 minutes;
- 124° F. (51° C.) can lead to a second degree burn in 2 minutes and third degree burn in 4 minutes;
- 131° F. (55° C.) can lead to a second degree burn in 17 seconds and third degree burn in 30 seconds;
- 140° F. (60° C.) can lead to a second degree burn in 3 seconds and third degree burn in 5 seconds;
- 158° F. (70° C.) can lead to a third degree burn in 1 second; and
- 162° F. (72° C.) can lead to essentially instant skin cell destruction.

Thus, to protect skin of the user of a curling iron from potential burns due to inadvertent contact with a heated surface of the curling iron, an elongate, hollow, substantially partially-cylindrical barrel guard 1200 can be installed over, snugly contact, and/or partially cover a predetermined portion 1146 of barrel 1140 and/or metallic outer barrel surface 1144. Barrel guard 1200 can be formed from a stretchable, flexible, elastomeric material such that it can be stretchably, non-destructively, repeatably installed on and removed from barrel 1140 by the user without damage to barrel guard 1200 and/or barrel 1140.

In certain exemplary embodiments, barrel guard 1200 can define a partial ring-like, barrel guard penannular clip 1240 configured that can be stretched to fit over barrel 1140 in a direction falling within a plane that is perpendicular to the longitudinal axis L-L of barrel 1140 before coming to rest on a portion of barrel 1140 located on barrel 1140 and adjacent wand insulator 1130 in order to at least partially and/or non-destructively releasably secure barrel guard 1200 to barrel 1140.

Barrel guard 1200 can define a ring-like barrel guard annular retainer 1220 that is configured to secure barrel guard 1200 to barrel 1140 by sliding retainer 1220 over barrel tip 1142 such that retainer 1220 rests substantially on and around barrel 1140 in order to at least partially secure barrel guard 1200 to barrel 1140.

Barrel guard 1200 can define a plurality of elongate, substantially parallel, and longitudinally extending barrel guard spines 1260 connected to barrel guard retainer 1220. Barrel guard 1200 can define a plurality of substantially parallel, radially extending, and/or semi-circumferentially extending barrel guard ribs 1280 connected to at least two of the plurality of longitudinally extending barrel guard spines 1260. Each of barrel guard ribs 1280 can terminate in a barrel guard rib tip 1282. Between each adjacent pair of barrel guard ribs 1280 can be defined a substantially parallel, radially extending, and semi-circumferentially extending barrel guard gap 1284 that is configured to channel scalp hair of the user toward a metallic outer barrel surface 1144 while that hair is wrapped at least partially around barrel 1140. Any of barrel guard gaps 1284 can extend between the adjacent barrel guard rib tips 1282 to any depth between the corresponding barrel guard ribs 1280, including all the way to metallic outer barrel surface 1144.

Barrel guard 1200 can define a partially circumferentially extending barrel trigger bridge 1290 that longitudinally extends between the barrel guard clip 1240 and a barrel guard rib 1280 from the plurality of barrel guard ribs.

In certain exemplary embodiments, rather than defining a plurality of barrel guard ribs 1280, barrel guard 1200 can define a barrel guard plate 1250. In either event, barrel guard ribs 1280 and/or barrel guard plate 1250 can prevent contact between the metallic outer barrel surface 1144 and skin of the user.

To protect skin of the user from potential burns an elongate substantially partially-cylindrical clamp guard 1300 can be installed over a predetermined portion of clamp 1160. Clamp guard 1300 can be formed from a stretchable, flexible, elastomeric material such that it can be stretchably, non-destructively, repeatably installed on and removed from clamp 1160 without damage to clamp guard 1300 and/or clamp 1160. Potential materials of construction for clamp guard 1160 include those described herein for barrel guard 1200.

Clamp guard 1300 can be configured to snugly contact and partially cover a first predetermined portion of a metallic outer clamp surface 1162 of clamp 1160.

Clamp guard 1300 can define a pair of substantially parallel and longitudinally extending clamp guard spines 1360. Clamp guard 1300 can define a pair of substantially parallel and longitudinally extending clamp guard retaining lips 1320 that are configured to secure the clamp guard 1300 to clamp 1160, each of the clamp guard retaining lips 1320 connected to a corresponding clamp guard spine 1360. Clamp guard 1300 can define a plurality of substantially parallel, radially extending, and semi-circumferentially extending clamp guard ribs 1340 that are connected to the pair of clamp guard spines 1360 and/or are configured to prevent contact between the metallic outer clamp surface 1162 and skin of the user. Each of clamp guard ribs 1340 can terminate in a clamp guard rib tip 1342.

Clamp guard 1300 can define a plurality of substantially parallel, radially extending, and semi-circumferentially extending clamp guard gaps 1344, each of clamp guard gaps 1344 defined between an adjacent pair of clamp guard ribs 1340 and/or configured to channel scalp hair of the user toward a metallic outer clamp surface 1162 while that hair is wrapped over clamp 1160. Any of clamp guard gaps 1344 can extend between the adjacent rib tips to any depth between the corresponding ribs, including all the way to metallic outer clamp surface 1162. Each clamp guard rib tip 1342 can be configured to direct a portion of the user's scalp hair into an adjacent clamp guard gap 1344 and/or into contact with metallic outer clamp surface 1162.

Potential materials of construction for barrel guard 1200 and/or clamp guard 1300 include a single, blended, and/or composite polymeric material, such as a molded, stamped, machined, and/or 3D-printed elastomeric material, such as a polysiloxane (silicone rubber), polyurethane, ethylene acrylic elastomer, hydrogenated acrylonitrile-butadiene rubber, ethylene-propylene-diene monomer (EDPM) rubber, fluoroelastomer, perfluoroelastomer, and/or fluorosilicone. Example products include True Silicone A60 by Spectroplast AG of Zurich, Switzerland; Permatex RTV High Temp Gasket Maker; FLHTAM02 photopolymer High Temp Resin for Form 2 3D printers from FormLabs of Somerville, MA; and Viton ® and Kalrez ® elastomers from DuPont of Wilmington, DE; silicone elastomers from Dow Corning of Midland, MI, etc.

In certain exemplary embodiments, rather than defining a plurality of clamp guard ribs 1340, clamp guard 1300 can define a clamp guard plate 1350 that is configured to prevent any of the user's scalp hair from directly contacting metallic outer clamp surface 1162.

In certain exemplary embodiments, a first barrel guard that includes barrel guard ribs and a second barrel guard that excludes barrel guard ribs in favor of a barrel guard plate can be interchangeable. In certain exemplary embodiments, a first clamp guard that includes clamp guard ribs and a second clamp guard that excludes clamp guard ribs in favor of a clamp guard plate can be interchangeable. Each user-selected combination of the first barrel guard with the first clamp guard, the first barrel guard with the second clamp guard, the second barrel guard with the first clamp guard, and the second barrel guard with the second clamp guard can be configured to operably cause a particular corresponding curling effect on the user's hair and/or to expose the hair to a particular temperature and/or temperature profile.

As a general principle, up to a point where the hair begins to singe and/or burn, the more heat applied to the hair via a curling iron around and/or within which the hair is curled, the more curl will be imparted to the hair and/or the longer the curl will persist. Thus, if the user installs on the curling iron a clamp guard that includes, for example, a clamp guard plate that substantially prevents hair from contacting the outer surface of the clamp, then everything else being equal, upon use of the curling iron, the user's hair will have less curl imparted thereto and/or discontinuous curls imparted thereto compared with the situation where a clamp guard having ridges that allowed contact of the hair with the outer surface of the clamp were installed. Nevertheless, provided the hair is exposed to a substantially elevated temperature (with respect to ambient), such a configuration could nevertheless impart some effect, such as more body, to the hair than if no heat were applied to the hair at all.

As another example, if the user installs on the curling iron a barrel guard that includes a barrel guard plate, then everything else being equal, upon use of the curling iron, the user's hair will have less curl than if a barrel guard having ridges were used, yet with more body than if no curling iron were used.

To operate curling iron 1100, with or without the guards of hair curling iron burn guard system 1000 installed, an end sub-portion of a selected portion of the user's scalp hair can be clamped between clamp inner surface 1164 and barrel 1140, at a location proximal to clamp hinge 1182. Generally speaking, the larger the selected portion, the looser the curl. With the end sub-portion clamped, curling iron 1100 then can be rotated slowly about its longitudinal axis L-L such that the selected portion of the user's hair wraps around barrel 1140 and barrel 1140 advances along that selected portion toward the scalp. When curling iron 1100 approaches a complete revolution, clamp 1160 can be slightly opened to allow the approaching sub-portion of the hair to be inserted between clamp inner surface 1164 and barrel 1140 and then clamp 1160 can be closed to trap that sub-portion of the hair against barrel 1140. The process can be repeated until the desired length of the selected portion of the user's hair has been wrapped around curling iron 1100. The selected portion of the user's hair can be heated by curling iron 1100 for a user-desired length of time to impart the degree of curl desired. Of course, another person can operate the curling iron on the user's hair.

An alternative curling approach is to trap only the end sub-portion of the selected portion of the user's hair such that each revolution advances the remainder of the selected portion around barrel 1140 and clamp outer surface 1162. If a barrel guard 1200 is installed on curling iron 1100, the structure and geometry of that barrel guard 1200 can impact the curl imparted on the sub-portions of the selected portion of the user's hair that contacts or is adjacent to that barrel guard 1200. Likewise, if a clamp guard 1300 is installed on curling iron 1100, the structure and geometry of that clamp guard 1300 can impact the curl imparted on the sub-portions of the selected portion of the user's hair that contacts or is adjacent to that clamp guard 1300.

Via another alternative approach, a selected portion of the user's hair can be wrapped around the curling iron 1100 starting from a point roughly mid-way between the scalp and the end of that selected portion, the wrapping proceeding toward the end of that selected portion. This approach can, but need not, utilize clamp 1160 to hold the mid-portion of the selected portion of hair.

According to yet another approach, a selected portion of the user's hair can be clamped near the scalp and wrapping can proceed in the direction of the end of that selected portion. Each revolution can, but need not, be inserted between clamp 1160 and barrel 1140.

Any combination of these approaches, and/or others, can be utilized to obtain the desired curling effect.

In certain exemplary embodiments, the centerlines of barrel guard ribs 1280 can be spaced between 0.0625" and 1" apart (including all values and sub-ranges therebetween, such as, e.g., 0.9275, 0.125, 0.1875, 0.23, 0.375, 0.511, 0.625, 0.75, and/or 0.878, etc. inches). In certain exemplary embodiments, the height of barrel guard ribs 1280 in a radial direction can be from 0 to 0.5 inches (including all values and sub-ranges therebetween, such as, e.g., 0.05, 0.0625, 0.9275, 0.1, 0.125, 0.15, 0.1875, 0.2, 0.252, 0.28125, 0.3125, 0.333, 0. 375, and/or 0.4125, etc. inches). In certain exemplary embodiments, the height of barrel guard spines 1260 in a radial direction can be from 0 to 0.25 inches (including all values and sub-ranges therebetween, such as, e.g., 0.025, 0.05, 0.0625, 0.9275, 0.1, 0.125, 0.15, 0.1875, 0.2, and/or 0.2125, etc. inches). In certain exemplary embodiments, the height of barrel guard plate 1250 in a radial direction can be from 0 to 0.25 inches (including all values and sub-ranges therebetween, such as, e.g., 0.025, 0.05, 0.0625, 0.9275, 0.1, 0.125, 0.15, 0.1875, 0.2, and/or 0.2125, etc. inches).

The centerlines of barrel guard ribs 1280 can, but need not, all share a common spacing. Barrel guard ribs 1280 can, but need not, share the same height. A given barrel guard rib 1280 can, but need not, have a constant height as it traverses the outer surface of barrel guard 1200. Barrel guard rib tips 1282 can, but need not, have an identical cross-sectional shape, dimensions, or contour. Barrel guard spines 1260 can, but need not, have a constant height along their length. Barrel guard plate 1250 can, but need not, have a constant height along its length and/or width.

The dimensions of barrel guard gaps 1284 can depend on the spacing, contour, and thickness of barrel guard ribs 1280. For example, a cross section of a pair of adjacent barrel guard ribs 1280 need not reveal flat sides, but instead those sides can be angled and/or curved such that the width of the corresponding gap defined between those ribs can vary from its top to its bottom. Note also that a gap need not extend the full radial height of its adjacent ribs. That is, a gap need not extend completely through barrel guard 1200.

In certain exemplary embodiments, the centerlines of clamp guard ribs 1340 can be spaced between 0.0625" and 1" apart (including all values and sub-ranges therebetween, such as, e.g., 0.9275, 0.125, 0.1875, 0.23, 0.375, 0.511, 0.625, 0.75, and/or 0.878, etc. inches). In certain exemplary embodiments, the height of clamp guard ribs 1340 in a radial direction can be from 0 to 0.5 inches (including all values and sub-ranges therebetween, such as, e.g., 0.05, 0.0625, 0.9275, 0.1, 0.125, 0.15, 0.1875, 0.2, 0.252, 0.28125, 0.3125, 0.333, 0. 375, and/or 0.4125, etc. inches). In certain exemplary embodiments, the height of clamp guard spines 1360 in a radial direction can be from 0 to 0.25 inches (including all values and sub-ranges therebetween, such as, e.g., 0.025, 0.05, 0.0625, 0.9275, 0.1, 0.125, 0.15, 0.1875, 0.2, and/or 0.2125, etc. inches). In certain exemplary embodiments, the height of clamp guard plate 1350 in a radial direction can be from 0 to 0.25inches (including all values and sub-ranges therebetween, such as, e.g., 0.025, 0.05, 0.0625, 0.9275, 0.1, 0.125, 0.15, 0.1875, 0.2, and/or 0.2125, etc. inches).

The centerlines of clamp guard ribs 1340 can, but need not, all share a common spacing. Clamp guard ribs 1340 can, but need not, share the same height. A given clamp guard rib 1340 can, but need not, have a constant height as it traverses the outer surface of clamp guard 1300. Clamp guard rib tips 1342 can, but need not, have an identical cross-sectional shape, dimensions, or contour. Clamp guard spines 1360 can, but need not, have a constant height along their length. Clamp guard plate 1350 can, but need not, have a constant height along its length and/or width.

The dimensions of clamp guard gaps 1344 can depend on the spacing, contour, and thickness of clamp guard ribs 1340. For example, a cross section of a pair of adjacent barrel guard ribs 1340 need not reveal flat sides, but instead those sides can be angled and/or curved such that the width of the corresponding gap defined between those ribs can vary from its top to its bottom. Note also that a gap need not extend the full radial height of its adjacent ribs. That is, a gap need not extend completely through clamp guard 1300. Moreover, all of clamp guard ribs 1340 need not share the same height. Likewise, a given clamp guard rib 1340 need not have a constant height as it traverses the outer surface of clamp guard 1300.

This application incorporates by reference U.S. Pat. No. 4,673,798 (Conti) in its entirety and particularly for its description of dual temperature curling irons; multi-position switches; metal barrels; electric heaters; low temperature thermostats and high temp thermostats; timing circuits; and visual ready signals.

Certain exemplary embodiments can provide a burn guard system configured to operably prevent burns to the skin of a user of a heated hair curling iron, comprising any of:

an elongate hollow substantially partially-cylindrical first barrel guard configured to snugly contact and partially cover a first predetermined portion of a metallic outer barrel surface of an elongate substantially cylindrical barrel of the hair curling iron, the barrel configured to substantially surround a heating system of the hair curling iron, the heating system configured to substantially maintain the metallic outer barrel surface at a predetermined temperature, the first barrel guard configured to be stretchably and non-destructively removable from and re-installable on the barrel by the user, the first barrel guard defining:

an annular first barrel guard retainer configured to secure the first barrel guard to the barrel;

a penannular first barrel guard clip configured to non-destructively releasably secure the first barrel guard to the barrel;

a plurality of substantially parallel and longitudinally extending first barrel guard spines connected to the first barrel guard retainer;

a plurality of substantially parallel, radially extending, and semi-circumferentially extending barrel guard ribs connected to at least two of the plurality of longitudinally extending barrel guard spines;

a plurality of substantially parallel, radially extending, and semi-circumferentially extending barrel guard gaps; and/or a first barrel trigger bridge extending between the first barrel guard clip and a barrel guard rib from the plurality of barrel guard ribs;

wherein:

each barrel guard gap from the plurality of barrel guard gaps is located between an adjacent pair of barrel guard ribs from the plurality of barrel guard ribs and is configured to channel scalp hair of the user toward the metallic outer barrel surface while that hair is wrapped around the curling iron;

each barrel guard rib from the plurality of barrel guard ribs defines a semi-circumferentially extending barrel guard rib tip and is configured to prevent contact between the metallic outer barrel surface and skin of the user; and/or each barrel guard rib tip is configured to direct a portion of the scalp hair into an adjacent barrel guard gap from the plurality of barrel guard gaps;

an elongate substantially partially-cylindrical first clamp guard configured to snugly contact and partially cover a first predetermined portion of a metallic inner clamp surface of an elongate, substantially partially-cylindrical, metallic clamp of the hair curling iron, the metallic inner clamp surface biased into a position substantially adjacent to and/or in contact with the metallic outer barrel surface, the clamp defining a metallic outer clamp surface, the first clamp guard configured to be stretchably and non-destructively removable from and re-installable on the clamp by the user, the first clamp guard defining:

a pair of substantially parallel and longitudinally extending first clamp guard spines;

a pair of substantially parallel and longitudinally extending first clamp guard retaining lips configured to secure the first clamp guard to the clamp, each of the first clamp guard retaining lips connected to a corresponding first clamp guard spine;

a plurality of substantially parallel, radially extending, and semi-circumferentially extending first clamp guard ribs connected to the pair of first clamp guard spines; and/or a plurality of substantially parallel, radially extending, and semi-circumferentially extending first clamp guard gaps;

wherein:

each clamp guard gap from the plurality of clamp guard gaps is defined between two adjacent clamp guard ribs from the plurality of clamp guard ribs and is configured to channel scalp hair of the user toward a metallic outer clamp surface of the clamp while that hair is wrapped over the clamp;

each clamp guard rib from the plurality of clamp guard ribs is configured to prevent contact between the metallic outer clamp surface of the clamp and skin of the user; and/or each clamp guard rib tip from the plurality of clamp guard rib tips to configured to direct a portion of the scalp hair into an adjacent clamp guard gap from the plurality of clamp guard gaps;

an elongate hollow substantially partially cylindrical second barrel guard configured to snugly contact and partially cover a second predetermined portion of the metallic outer barrel surface of the barrel, the second barrel guard configured to be stretchably and non-destructively removable from and re-installable on the barrel by the user, the second barrel guard defining:

an annular second barrel guard retainer configured to secure the second barrel guard to the barrel;

a penannular second barrel guard clip configured to non-destructively releasably secure the second barrel guard to the barrel;

a barrel guard plate connected to the second barrel guard clip and configured to prevent contact between skin of a user and a predetermined sub-portion of the predetermined portion of the metallic outer barrel surface; and/or a second barrel trigger bridge configured to connect the barrel guard plate with the second barrel guard clip; and/or an elongate substantially partially-cylindrical second clamp guard configured to snugly contact and partially cover a second predetermined portion of a metallic inner clamp surface of the metallic clamp, the second clamp guard configured to be stretchably and non-destructively removable from and re-installable on the clamp by the user, the second clamp guard defining:

a pair of substantially parallel and longitudinally extending second clamp guard spines;

a pair of substantially parallel and longitudinally extending second clamp guard retaining lips configured to secure the second clamp guard to the clamp, each of the second clamp guard retaining lips connected to a corresponding second clamp guard spine; and/or a clamp guard plate connected to the second clamp guard spines and configured to prevent contact between the barrel and skin of a user of the curling iron;

wherein:

the first barrel guard and second barrel guard are configured to be interchangeable by the user;

the first clamp guard and second clamp guard are configured to be interchangeable by the user; each user-selected combination of the first barrel guard with the first clamp guard, the first barrel guard with the second clamp guard, the second barrel guard with the first clamp guard, and the second barrel guard with the second clamp guard is configured to operably cause a corresponding curling effect on the user's hair;

the plurality of barrel guard gaps extend to the metallic outer barrel surface;

the plurality of clamp guard gaps extend to the metallic outer clamp surface; the plurality of first barrel guard ribs substantially contact the metallic outer barrel surface; the plurality of first clamp guard ribs substantially contact the metallic outer clamp surface;

the first clamp guard retaining lips substantially contact the metallic inner clamp surface;

the second clamp guard retaining lips substantially contact the metallic inner clamp surface;

the system is configured to operably prevent an outer surface of each of the selected guards in the user-selected combination from exceeding 140 degrees F.;

any pair of adjacent barrel guard gaps from the plurality of barrel guard gaps are no wider than 0.5 inches;

the first clamp guard is configured to be slidably received on the clamp;

the second clamp guard is configured to be slidably received on the clamp;

the second clamp guard is configured to be slidably received on the clamp;

each user-selected combination of the first barrel guard with the first clamp guard, the first barrel guard with the second clamp guard, the second barrel guard with the first clamp guard, and the second barrel guard with the second clamp guard is operatively configured to prevent contact between the user's skin and the metallic outer barrel surface and the metallic outer clamp surface; and/or the barrel guard plate is configured to operatively avoid interfering in a biasing of the clamp toward the barrel.

Definitions

When the following phrases are used substantively herein, the accompanying definitions apply. These phrases and definitions are presented without prejudice, and, consistent with the application, the right to redefine these phrases via amendment during the prosecution of this application or any application claiming priority hereto is reserved. For the purpose of interpreting a claim of any patent that claims priority hereto, each definition in that patent functions as a clear and unambiguous disavowal of the subject matter outside of that definition.

a—at least one.

about—around and/or approximately.

above—at a higher level.

across—from one side to another.

activity—an action, act, step, and/or process or portion thereof.

adapt—to design, make, set up, arrange, shape, configure, and/or make suitable and/or fit for a specific purpose, function, use, and/or situation.

adjacent—close to; lying near; next to; adjoining, and/or within a horizontal radius of approximately 0 to approximately 0.5 inches of, including all values and subranges therebetween.

after—following in time and/or subsequent to.

along—through, on, beside, over, in line with, and/or parallel to the length and/or direction of; and/or from one end to the other of.

and—in conjunction with.

and/or—either in conjunction with or in alternative to.

annular—shaped like a ring.

any—one, some, every, and/or all without specification.

apparatus—an appliance or device for a particular purpose.

approximately—about and/or nearly the same as.

are—to exist.

around—about, surrounding, and/or on substantially all or one or more sides of; and/or approximately.

as long as—if and/or since.

associate—to join, connect together, and/or relate.

at—in, on, and/or near.

at least—not less than, and possibly more than.

avoid—to actually and/or attempt prevent and/or resist from happening.

axis—a straight line about which a body and/or geometric object rotates and/or can be conceived to rotate and/or a center line to which parts of a structure and/or body can be referred.

barrel—a substantially cylindrical and/or hollow part.

based on—indicating one or more factors that affect a determination, but not necessarily foreclosing additional factors that might affect that determination.

be—to exist in actuality.

between—in a separating interval and/or intermediate to.

bias—to urge in a direction.

biased—urged in a direction.

bridge—an elongated member supported at least at two spaced points.

burn—a second or third degree burn of human skin by—via and/or with the use and/or help of can—is capable of, in at least some embodiments.

cause—to bring about, provoke, precipitate, produce, elicit, be the reason for, result in, and/or effect.

channel—(v) to cause to flow and/or move via and/or through a defined passage, conduit, and/or groove; (n) a defined passage, conduit, and/or groove.

channel—to direct along a path.

circuit—a physical system comprising, depending on context: an electrically conductive pathway, an information transmission mechanism, and/or a communications connection, the pathway, mechanism, and/or connection established via a switching device (such as a switch, relay, transistor, and/or logic gate, etc.); and/or an electrically conductive pathway, an information transmission mechanism, and/or a communications connection, the pathway, mechanism, and/or connection established across two or more switching devices comprised by a network and between corresponding end systems connected to, but not comprised by the network.

clamp—n. a device used to join, grip, support, and/or compress. v. to join, grip, support, and/or compress.

clip—(n) a springably movable weight bearing and/or motion restraining structural component adapted to hold a first object together with respect to a second object. (v) to fasten with a clip.

combination—an ordered arrangement of two or more entities.

composition of matter—a combination, reaction product, compound, mixture, formulation, material, and/or composite formed by a human and/or automation from two or more substances and/or elements.

comprising—including but not limited to.

conceive—to imagine, conceptualize, form, and/or develop in the mind.

configure—to design, arrange, set up, shape, and/or make suitable and/or fit for a specific purpose, function, use, and/or situation.

configured to—designed, arranged, set up, shaped, and/or made suitable and/or fit for a specific purpose, function, use, and/or situation, and/or having a structure that, during operation, will perform the indicated activity(ies). To the extent relevant to the current application, the use of "configured to" is expressly not intended to invoke 35 U.S.C. § 112(f) for that structure.

connect—to physically or logically integrate, form integrally, join, link, couple, and/or fasten together two or more entities.

contact—to physically touch and/or come together.

containing—including but not limited to.

convert—to transform, adapt, and/or change.

corresponding—related, associated, accompanying, similar in purpose and/or position, conforming in every respect, and/or equivalent and/or agreeing in amount, quantity, magnitude, quality, and/or degree.

coupleable—capable of being joined, connected, and/or linked together.

coupling—linking in some fashion.

cover—(v) to overlay, place upon and/or over, and/or immerse; (n) an object configured to protect and/or conceal.

create—to bring into being.

curl—(v) to twist (the hair, for example) into ringlets and/or coils; to form into a coiled and/or spiral shape; (n) something with a spiral and/or coiled shape; a coil and/or ringlet of hair; a treatment in which the hair is curled.

curling iron—a substantially cylindrical metal home appliance configured to heat a lock of hair that has been curled around it.

cylindrical—of, relating to, and/or having the shape of a cylinder, especially of a circular cylinder.

define—to establish the meaning, relationship, outline, form, and/or structure of and/or to precisely and/or distinctly describe and/or specify.

degree—a measure of temperature according to a specified scale, such as

Fahrenheit, Celsius, etc.

derive—to receive, obtain, and/or produce from a source and/or origin.

determine—to find out, obtain, calculate, decide, deduce, ascertain, and/or come to a decision, typically by investigation, reasoning, and/or calculation.

device—a machine, manufacture, and/or collection thereof direct—to point, aim, and/or send toward a place or object; to cause to move in or follow a predetermined course; and/or to control and/or cause.

each—every one of a group considered individually.

effect—to bring into existence, to bring about, provoke, elicit, and/or cause a result and/or to produce as a result and/or such a result.

effective—sufficient to bring about, provoke, elicit, and/or cause.

elongated—drawn out, made spatially longer, and/or having more length than embodiment—an implementation, manifestation, and/or concrete representation.

estimate—(n) a calculated value approximating an actual value; (v) to calculate and/or determine approximately and/or tentatively.

exceeding—greater than.

exemplary—serving as an example, instance, and/or illustration.

extend—to reach spatially outward, stretch, cover, and/or span.

extending—existing, located, placed, and/or stretched lengthwise.

first—a label for a referenced element in one or more patent claims, but that label does not necessarily imply any type of ordering to how that element (or any other elements of a similar type) is implemented in embodiments of the claimed subject matter.

first—an initial entity in an ordering.

for—with a purpose of from—used to indicate a source, origin, and/or location thereof.

further—in addition.

gap—a space between objects.

generate—to create, produce, give rise to, and/or bring into existence.

given—an existing and/or specified.

guard—(n) a mechanism, device, and/or attachment configured to protect against, prevent, and/or seek to avoid the occurrence of injury, damage, loss, a given effect, and/or a given condition; an attachment and/or covering put on a machine and/or device to protect the operator and/or a part of the machine and/or device; (v) to protect against, prevent, and/or seek to avoid the occurrence of injury, damage, loss, a given effect, and/or a given condition.

hair—any of the numerous fine, usually cylindrical, keratinous filaments growing from the skin of mammals; a pilus; and/or an aggregate of such filaments covering, e.g., the human head.

having—including but not limited to.

heat—energy associated with the motion of atoms and/or molecules and capable of being transmitted through solid and fluid media by conduction, through fluid media by convection, and through a fluid and/or empty space by radiation.

heating—transferring energy from one substance to another resulting in an increase in temperature of one substance.

hollow—having a hole, cavity, and/or space within; not solid.

including—including but not limited to.

initialize—to prepare something for use and/or some future event.

inner—closer than another to the center and/or middle.

install—to connect or set in position and prepare for use.

interchange—to switch each of (two or more things) into the place of the other.

interfer—to obstruct and/or impede.

into—to a condition, state, or form of and/or toward, in the direction of, and/or to the inside of.

is—to exist in actuality.

lip—a protruding edge.

located—situated approximately in a particular spot and/or position.

longitudinal—of and/or relating to a length; placed and/or running lengthwise.

longitudinal axis—a straight line defined parallel to an object's length and passing through a centroid of the object.

maintain—to retain, preserve, sustain, keep in an existing state, and/or continue to obtain.

may—is allowed and/or permitted to, in at least some embodiments.

metallic—composed substantially of one or more metals.

method—one or more acts that are performed upon subject matter to be transformed to a different state or thing and/or are tied to a particular apparatus, said one or more acts not a fundamental principal and not pre-empting all uses of a fundamental principal.

near—a distance of less than approximately [X].

no—an absence of and/or lacking any.

non-destructively—to perform substantially without damaging.

one—being and/or amounting to a single unit, individual, and/or entire thing, item, and/or object.

operable—practicable and/or fit, ready, and/or configured to be put into its intended use and/or service.

operative—when in operation for its intended use and/or service.

operatively—in a manner able to function and/or to work.

or—a conjunction used to indicate alternatives, typically appearing only before the last item in a group of alternative items.

outer—farther than another from the center and/or middle.

outside—beyond a range, boundary, and/or limit; and/or not within.

pair—a set of two items.

parallel—of, relating to, or designating lines, curves, planes, and/or or surfaces everywhere equidistant.

partially—to a degree, but not necessarily totally.

partially cover—overlayed to a degree, but not necessarily totally overlayed.

partially-cylindrical—having the shape of a cylinder and/or cylindrical wall that has been divided by a plane oriented parallel to its longitudinal axis.

penannular—a portion of an annulus formed by slicing the annulus with a plane that extend perpendicular to a central axis of the annulus.

per—for each and/or by means of.

perpendicular—intersecting at or forming substantially right angles.

plate—(n) a substantially sheet-like and/or planar body having a thickness measured perpendicular to the plane that is relatively small in comparison to the width and length of the body.

plurality—the state of being plural and/or more than one.

portion—a part, component, section, percentage, ratio, and/or quantity that is less than a larger whole. Can be visually, physically, and/or virtually distinguishable and/or non-distinguishable.

position—(n) a place and/or location, often relative to a reference point.

(v) to place and/or locate.

pre-—a prefix that precedes an activity that has occurred beforehand and/or in advance.

predetermine—to determine, decide, and/or establish in advance.

prevent—to impede, resist, hinder, avert, stop, and/or keep from happening.

prior—before and/or preceding in time or order.

probability—a quantitative representation of a likelihood of an occurrence.

product—something produced by human and/or mechanical effort.

project—to calculate, estimate, or predict.

provide—to furnish, supply, give, and/or make available.

radially—in a manner that radiates from and/or converges to a common center.

range—a measure of an extent of a set of values and/or an amount and/or extent of variation.

ratio—a relationship between two quantities expressed as a quotient of one divided by the other.

re-installable—able to be reinstalled.

receive—to gather, take, acquire, obtain, accept, get, and/or have bestowed upon.

recommend—to suggest, praise, commend, and/or endorse.

reduce—to make and/or become lesser and/or smaller.

releasably—capable of being freed, in a substantially non-destructive manner, from something that attaches, binds, fastens, secures, and/or holds back.

removable—capable of being removed.

remove—to eliminate, remove, and/or delete, and/or to move from a place and/or position occupied.

repeat—to do again and/or perform again.

repeatedly—again and again; repetitively.

request—to express a desire for and/or ask for.

result—(n.) an outcome and/or consequence of a particular action, operation, and/or course; (v.) to cause an outcome and/or consequence of a particular action, operation, and/or course.

retain—to restrain or guide.

retainer—a device adapted to restrain motion of one object relative to another object in at least one direction.

rib—a long, narrow membere, part, and/or element similar in function and/or appearance to an anatomical rib, especially a structural and/or supporting member and/or a raised strip and/or ridge that projects from a surface and/or spine.

said—when used in a system or device claim, an article indicating a subsequent claim term that has been previously introduced.

scalp—the skin covering the top of the human head.

second—a label for an element in one or more patent claims, the element other than a "first" referenced element of a similar type, but the label does not necessarily imply any type of ordering to how that "second" element or the "first" element is implemented in embodiments of the claimed subject matter; and/or immediately following an initial item in an ordering.

secure—to fasten, connect, and/or prevent substantial relative movement of.

select—to make a choice or selection from alternatives.

selected—chosen from a plurality of alternatives.

semi-circumferentially—extending around a portion of a circumference.

set—a related plurality.

skin—the membranous tissue forming the external covering or integument of an animal and consisting in vertebrates of the epidermis and dermis.

slidably—to be able to open, close, and/or fit together with a sliding motion of a first part relative to a second part.

snugly—close-fitting and/or securely.

species—a class of individuals and/or objects grouped by virtue of their common attributes and assigned a common name; a division subordinate to a genus.

spine—anything resembling a spinal column in function and/or importance; main support or feature.

store—to place, hold, and/or retain data, typically in a memory.

stretch—to lengthen, widen, and/or distend.

stretchably—having the ability to substantially stretch.

sub-portion—a portion of a portion.

substantially—to a considerable, large, and/or great, but not necessarily whole and/or entire, extent and/or degree.

support—to bear the weight of, especially from below.

surface—the exterior and/or outer boundary of an object and/or a material layer constituting and/or resembling such a boundary.

surround—to extend on all sides of simultaneously, encircle, enclose, and/or confine on all sides.

switch—(v) to: form, open, and/or close one or more circuits; form, complete, and/or break an electrical and/or informational path; select a path and/or circuit from a plurality of available paths and/or circuits; and/or establish a connection between disparate transmission path segments in a network (or between networks); (n) a physical device, such as a mechanical, electrical, and/or electronic device, that is adapted to switch.

system—a collection of mechanisms, devices, machines, articles of manufacture, processes, data, and/or instructions, the collection designed to perform one or more specific, practical, concrete, tangible, and/or useful functions.

temperature—measure of the average kinetic energy of the molecules in a sample of matter, expressed in terms of units or degrees designated on a standard scale.

that—a pronoun used to indicate a thing as indicated, mentioned before, present, and/or well known; used as the subject or object of a relative clause.

through—across, among, between, and/or in one side and out the opposite and/or another side of tip—a terminal end.

to—a preposition adapted for use for expressing purpose.

toward—used to indicate a destination and/or in a physical and/or logical direction of.

transform—to change in measurable: form, appearance, nature, and/or character.

transmit—to send as a signal, provide, furnish, and/or supply.

treatment—an act, manner, or method of handling and/or dealing with someone and/or something.

trigger—(n) a device, such as a lever, the pulling or pressing of which causes a predetermined action to take place.

two—a cardinal number equal to one plus one.

upon—immediately or very soon after; and/or on the occasion of.

use—to put into service.

user—a person, organization, process, device, program, protocol, and/or system that uses a device, system, process, and/or service.

user-selected—chosen by a user.

via—by way of and/or utilizing.

weight—a force with which a body is attracted to Earth or another celestial body, equal to the product of the object's mass and the acceleration of gravity; and/or a factor and/or value assigned to a number in a computation, such as in determining an average, to make the number's effect on the computation reflect its importance, significance, preference, impact, etc.

when—at a time and/or during the time at which.

wherein—in regard to which; and; and/or in addition to.

while—for as long as, during the time that, and/or at the same time that.

wider—greater in extent from side to side.

with—accompanied by.

with respect to—about, regarding, relative to, and/or in relation to.

within—inside the limits of.

wrap—to wind, cradle, fold, and/or bind (something) about as a covering and/or support.

zone—a region and/or volume having at least one predetermined boundary.

Note

Various substantially and specifically practical and useful exemplary embodiments of the claimed subject matter are described herein, textually and/or graphically, including the best mode, if any, known to the inventor(s), for implementing the claimed subject matter by persons having ordinary skill in the art. References herein to "in one embodiment", "in an embodiment", or the like do not necessarily refer to the same embodiment.

Any of numerous possible variations (e.g., modifications, augmentations, embellishments, refinements, and/or enhancements, etc.), details (e.g., species, aspects, nuances, and/or elaborations, etc.), and/or equivalents (e.g., substitutions, replacements, combinations, and/or alternatives, etc.) of one or more embodiments described herein might become apparent upon reading this document to a person having ordinary skill in the art, relying upon his/her expertise and/or knowledge of the entirety of the art and without exercising undue experimentation. The inventor(s) expects any person having ordinary skill in the art, after obtaining authorization from the inventor(s), to implement such variations, details, and/or equivalents as appropriate, and the inventor(s) therefore intends for the claimed subject matter to be practiced other than as specifically described herein. Accordingly, as permitted by law, the claimed subject matter includes and covers all variations, details, and equivalents of that claimed subject matter. Moreover, as permitted by law, every combination of the herein described characteristics, functions, activities, substances, and/or structural elements, and all possible variations, details, and equivalents thereof, is encompassed by the claimed subject matter unless otherwise clearly indicated herein, clearly and specifically disclaimed, or otherwise clearly unsuitable, inoperable, or contradicted by context.

The use of any and all examples, or exemplary language (e.g., "such as") provided herein, is intended merely to better illuminate one or more embodiments and does not pose a limitation on the scope of any claimed subject matter unless otherwise stated. No language herein should be construed as indicating any non-claimed subject matter as essential to the practice of the claimed subject matter.

Thus, regardless of the content of any portion (e.g., title, field, background, summary, description, abstract, drawing figure, etc.) of this document, unless clearly specified to the contrary, such as via explicit definition, assertion, or argument, or clearly contradicted by context, with respect to any claim, whether of this document and/or any claim of any document claiming priority hereto, and whether originally presented or otherwise:

- there is no requirement for the inclusion of any particular described characteristic, function, activity, substance, or structural element, for any particular sequence of activities, for any particular combination of substances, or for any particular interrelationship of elements;
- no described characteristic, function, activity, substance, or structural element is "essential"; and
- within, among, and between any described embodiments:
- any two or more described substances can be mixed, combined, reacted, separated, and/or segregated;
- any described characteristic, function, activity, substance, component, and/or structural element, or any combination thereof, can be specifically included, duplicated, excluded, combined, reordered, reconfigured, integrated, and/or segregated;
- any described interrelationship, sequence, and/or dependence between any described characteristics, functions, activities, substances, components, and/or structural elements can be omitted, changed, varied, and/or reordered;
- any described activity can be performed manually, semi-automatically, and/or automatically;
- any described activity can be repeated, performed by multiple entities, and/or performed in multiple jurisdictions.

The use of the terms "a", "an", "said", "the", and/or similar referents in the context of describing various embodiments (especially in the context of the following claims) are to be construed to cover both the singular and the plural, unless otherwise indicated herein or clearly contradicted by context.

The terms "comprising," "having," "including," and "containing" are to be construed as open-ended terms (i.e., meaning "including, but not limited to,") unless otherwise noted.

When any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate sub-range defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all sub-ranges therebetween, such as for example, 1 to 3.65, 2.8 to 8.14, 1.93 to 9, etc., even if those specific values or specific sub-ranges are not explicitly stated.

When any phrase (i.e., one or more words) appearing in a claim is followed by a drawing element number, that drawing element number is exemplary and non-limiting on claim scope.

No claim or claim element of this document is intended to invoke 35 USC 112(f) unless the precise phrase "means for" is followed by a gerund.

Any information in any material (e.g., a United States patent, United States patent application, book, article, web page, etc.) that has been incorporated by reference herein, is incorporated by reference herein in its entirety to its fullest enabling extent permitted by law yet only to the extent that no conflict exists between such information and the other definitions, statements, and/or drawings set forth herein. In the event of such conflict, including a conflict that would render invalid any claim herein or seeking priority hereto, then any such conflicting information in such material is specifically not incorporated by reference herein. Any specific information in any portion of any material that has been incorporated by reference herein that identifies, criticizes, or compares to any prior art is not incorporated by reference herein.

Applicant intends that each claim presented herein and at any point during the prosecution of this application, and in any application that claims priority hereto, defines a distinct patentable invention and that the scope of that invention must change commensurately if and as the scope of that claim changes during its prosecution. Thus, within this document, and during prosecution of any patent application related hereto, any reference to any claimed subject matter is intended to reference the precise language of the then-pending claimed subject matter at that particular point in time only.

Accordingly, every portion (e.g., title, field, background, summary, description, abstract, drawing figure, etc.) of this document, other than the claims themselves and any provided definitions of the phrases used therein, is to be regarded as illustrative in nature, and not as restrictive. The scope of subject matter protected by any claim of any patent that issues based on this document is defined and limited only by the precise language of that claim (and all legal equivalents thereof) and any provided definition of any phrase used in that claim, as informed by the context of this document when reasonably interpreted by a person having ordinary skill in the relevant art.

What is claimed is:

1. A burn guard system configured to operably prevent burns to the skin of a user of a heated hair curling iron, comprising:

an elongate hollow substantially partially-cylindrical first barrel guard configured to snugly contact and partially cover a first predetermined portion of a metallic outer barrel surface of an elongate substantially cylindrical barrel of the hair curling iron, the barrel configured to substantially surround a heating system of the hair curling iron, the heating system configured to substantially maintain the metallic outer barrel surface at a predetermined temperature, the first barrel guard configured to be stretchably and non-destructively removable from and re-installable on the barrel by the user, the first barrel guard defining:

an annular first guard retainer configured to secure the first barrel guard to the barrel;

a penannular first guard clip configured to non-destructively releasably secure the first barrel guard to the barrel;

a plurality of substantially parallel and longitudinally extending first barrel guard spines connected to the first guard retainer;

a plurality of substantially parallel, radially extending, and semi-circumferentially extending parallel barrel guard ribs connected to at least two of the plurality of longitudinally extending spines;

a plurality of substantially parallel, radially extending, and semi-circumferentially extending barrel guard gaps;

a first barrel trigger bridge extending between the first guard clip and a barrel guard rib from the plurality of barrel guard ribs;

wherein:

each barrel guard gap from the plurality of barrel guard gaps is located between an adjacent pair of barrel guard ribs from the plurality of barrel guard ribs and is configured to channel scalp hair of the user toward the metallic outer barrel surface while that hair is wrapped around the curling iron;

each barrel guard rib from the plurality of barrel guard ribs defines a semi-circumferentially extending barrel guard rib tip and is configured to prevent contact between the metallic outer barrel surface and skin of the user;

each barrel guard rib tip is configured to direct a portion of the scalp hair into an adjacent barrel guard gap from the plurality of barrel guard gaps;

an elongate substantially partially-cylindrical first clamp guard configured to snugly contact and partially cover a first predetermined portion of a metallic inner clamp surface of an elongate, substantially partially-cylindrical, metallic clamp of the hair curling iron, the metallic inner clamp surface biased into a position substantially adjacent to and/or in contact with the metallic outer barrel surface, the clamp defining a metallic outer clamp surface, the first clamp guard configured to be stretchably and non-destructively removable from and re-installable on the clamp by the user, the first clamp guard defining:

a pair of substantially parallel and longitudinally extending first clamp guard spines;

a pair of substantially parallel and longitudinally extending first clamp guard retaining lips configured to secure the first clamp guard to the clamp, each of the first clamp guard retaining lips connected to a corresponding first clamp guard spine;

a plurality of substantially parallel, radially extending, and semi-circumferentially extending first clamp guard ribs connected to the pair of first clamp guard spines;

a plurality of substantially parallel, radially extending, and semi-circumferentially extending first clamp guard gaps;

wherein:

each clamp guard gap from the plurality of clamp guard gaps is defined between two adjacent clamp guard ribs from the plurality of clamp guard ribs and is configured to channel scalp hair of the user toward a metallic outer clamp surface of the clamp while that hair is wrapped over the clamp;

each clamp guard rib from the plurality of clamp guard ribs is configured to prevent contact between the metallic outer clamp surface of the clamp and skin of the user;

each clamp guard rib tip from the plurality of clamp guard rib tips to configured to direct a portion of the scalp hair into an adjacent clamp guard gap from the plurality of clamp guard gaps;

an elongate hollow substantially partially cylindrical second barrel guard configured to snugly contact and partially cover a second predetermined portion of the metallic outer barrel surface of the barrel, the second barrel guard configured to be stretchably and non-destructively removable from and re-installable on the barrel by the user, the second barrel guard defining:

an annular second guard retainer configured to secure the second barrel guard to the barrel;

a penannular second guard clip configured to non-destructively releasably secure the second barrel guard to the barrel;

a barrel guard plate connected to the second guard clip and configured to prevent contact between skin of a user and a predetermined sub-portion of the predetermined portion of the metallic outer barrel surface; and a second barrel trigger bridge configured to connect the barrel guard plate with the second guard clip;

an elongate substantially partially-cylindrical second clamp guard configured to snugly contact and partially cover a second predetermined portion of a metallic inner clamp surface of the metallic clamp, the second clamp guard configured to be stretchably and non-destructively removable from and re-installable on the clamp by the user, the second clamp guard defining:

a pair of substantially parallel and longitudinally extending second clamp guard spines;

a pair of substantially parallel and longitudinally extending second clamp guard retaining lips configured to secure the second clamp guard to the clamp, each of the second clamp guard retaining lips connected to a corresponding second clamp guard spine;

a clamp guard plate connected to the second clamp guard spines and configured to prevent contact between the barrel and skin of a user of the curling iron;

wherein:

the first barrel guard and second barrel guard are configured to be interchangeable by the user;

the first clamp guard and second clamp guard are configured to be interchangeable by the user; and each user-selected combination of the first barrel guard with the first clamp guard, the first barrel guard with the second clamp guard, the second barrel guard with the first clamp guard, and the second barrel guard with the second clamp guard is configured to operably cause a corresponding curling effect on the user's hair.

2. The system of claim 1, wherein:

the plurality of barrel guard gaps extend to the metallic outer barrel surface.

3. The system of claim 1, wherein:

the plurality of clamp guard gaps extend to the metallic outer clamp surface.

4. The system of claim 1, wherein:

the plurality of first barrel guard ribs substantially contact the metallic outer barrel surface.

5. The system of claim 1, wherein:

the plurality of first clamp guard ribs substantially contact the metallic outer clamp surface.

6. The system of claim 1, wherein:

the first clamp guard retaining lips substantially contact the metallic inner clamp surface.

7. The system of claim 1, wherein:

the second clamp guard retaining lips substantially contact the metallic inner clamp surface.

8. The system of claim 1, wherein:

the system is configured to operably prevent an outer surface of each of the selected guards in the user-selected combination from exceeding 140 degrees F.

9. The system of claim 1, wherein:

any pair of adjacent barrel guard gaps from the plurality of barrel guard gaps are no wider than 0.5 inches.

10. The system of claim 1, wherein:

the first clamp guard is configured to be slidably received on the clamp.

11. The system of claim 1, wherein:

the second clamp guard is configured to be slidably received on the clamp.

12. The system of claim 1, wherein:

the second clamp guard is configured to be slidably received on the clamp.

13. The system of claim 1, wherein:

each user-selected combination of the first barrel guard with the first clamp guard, the first barrel guard with the second clamp guard, the second barrel guard with the first clamp guard, and the second barrel guard with the second clamp guard is operatively configured to prevent contact between the user's skin and the metallic outer barrel surface and the metallic outer clamp surface.

14. The system of claim 1, wherein:

the barrel guard plate is configured to operatively avoid interfering in a biasing of the clamp toward the barrel.

15. A burn guard system configured to operably prevent burns to the skin of a user of a heated hair curling iron, comprising:

an elongate hollow substantially partially-cylindrical first barrel guard configured to snugly contact and partially cover a first predetermined portion of a metallic outer barrel surface of an elongate substantially cylindrical barrel of the hair curling iron, the barrel configured to substantially surround a heating system of the hair curling iron, the heating system configured to substantially maintain the metallic outer barrel surface at a predetermined temperature, the first barrel guard configured to be stretchably and non-destructively removable from and re-installable on the barrel by the user, the first barrel guard defining:

an annular first guard retainer configured to secure the first barrel guard to the barrel;

a penannular first guard clip configured to non-destructively releasably secure the first barrel guard to the barrel;

a plurality of substantially parallel and longitudinally extending first barrel guard spines connected to the first guard retainer;

a plurality of substantially parallel, radially extending, and semi-circumferentially extending parallel barrel guard ribs connected to at least two of the plurality of longitudinally extending spines;

a plurality of substantially parallel, radially extending, and semi-circumferentially extending barrel guard gaps;

wherein:

each barrel guard gap from the plurality of barrel guard gaps is located between an adjacent pair of barrel guard ribs from the plurality of barrel guard ribs and is configured to channel scalp hair of the user toward the metallic outer barrel surface while that hair is wrapped around the curling iron;

an elongate substantially partially-cylindrical first clamp guard configured to snugly contact and partially cover a first predetermined portion of a metallic inner clamp surface of an elongate, substantially partially-cylindrical, metallic clamp of the hair curling iron, the metallic inner clamp surface biased into a position substantially adjacent to and/or in contact with the metallic outer barrel surface, the clamp defining a metallic outer clamp surface, the first clamp guard configured to be stretchably and non-destructively removable from and re-installable on the clamp by the user, the first clamp guard defining:

a pair of substantially parallel and longitudinally extending first clamp guard spines;

a pair of substantially parallel and longitudinally extending first clamp guard retaining lips configured to secure the first clamp guard to the clamp, each of the first clamp guard retaining lips connected to a corresponding first clamp guard spine;

a plurality of substantially parallel, radially extending, and semi-circumferentially extending first clamp guard ribs connected to the pair of first clamp guard spines;

a plurality of substantially parallel, radially extending, and semi-circumferentially extending first clamp guard gaps;

wherein:

each clamp guard gap from the plurality of clamp guard gaps is defined between two adjacent clamp guard ribs from the plurality of clamp guard ribs and is configured to channel scalp hair of the user toward a metallic outer clamp surface of the clamp while that hair is wrapped over the clamp;

an elongate hollow substantially partially cylindrical second barrel guard configured to snugly contact and partially cover a second predetermined portion of the metallic outer barrel surface of the barrel, the second barrel guard configured to be stretchably and non-destructively removable from and re-installable on the barrel by the user, the second barrel guard defining:

an annular second guard retainer configured to secure the second barrel guard to the barrel;

a penannular second guard clip configured to non-destructively releasably secure the second barrel guard to the barrel;

a barrel guard plate connected to the second guard clip and configured to prevent contact between skin of a user and a predetermined sub-portion of the predetermined portion of the metallic outer barrel surface; and a second barrel trigger bridge configured to connect the barrel guard plate with the second guard clip;

an elongate substantially partially-cylindrical second clamp guard configured to snugly contact and partially cover a second predetermined portion of a metallic inner clamp surface of the metallic clamp, the second clamp guard configured to be stretchably and non-destructively removable from and re-installable on the clamp by the user, the second clamp guard defining:

a pair of substantially parallel and longitudinally extending second clamp guard spines;

a pair of substantially parallel and longitudinally extending second clamp guard retaining lips configured to secure the second clamp guard to the clamp, each of the second clamp guard retaining lips connected to a corresponding second clamp guard spine;

a clamp guard plate connected to the second clamp guard spines and configured to prevent contact between the barrel and skin of a user of the curling iron;

wherein:

the first barrel guard and second barrel guard are configured to be interchangeable by the user;

the first clamp guard and second clamp guard are configured to be interchangeable by the user; and each user-selected combination of the first barrel guard with the first clamp guard, the first barrel guard with the second clamp guard, the second barrel guard with the first clamp guard, and the second barrel guard with the second clamp guard is configured to operably cause a corresponding curling effect on the user's hair.

* * * * *